US010487425B2

(12) United States Patent
Veil

(10) Patent No.: US 10,487,425 B2
(45) Date of Patent: Nov. 26, 2019

(54) METHOD AND APPARATUS FOR PRODUCING AND DRAWING-OFF A WEB-SHAPED PRODUCT, PARTICULARLY A WOVEN FABRIC WEB

(71) Applicant: Lindauer DORNIER Gesellschaft mit beschraenkter Haftung, Lindau (DE)

(72) Inventor: Martin Veil, Lindau (DE)

(73) Assignee: Lindauer DORNIER Gesellschaft mit beschraenkter Haftung, Lindau (DE)

( * ) Notice: Subject to any disclaimer, the term of this patent is extended or adjusted under 35 U.S.C. 154(b) by 47 days.

(21) Appl. No.: 15/768,720

(22) PCT Filed: Nov. 3, 2016

(86) PCT No.: PCT/EP2016/076490
§ 371 (c)(1),
(2) Date: Apr. 16, 2018

(87) PCT Pub. No.: WO2017/080896
PCT Pub. Date: May 18, 2017

(65) Prior Publication Data

US 2018/0313007 A1 Nov. 1, 2018

(30) Foreign Application Priority Data

Nov. 10, 2015 (DE) ..... 10 2015 222 142

(51) Int. Cl.
*D03D 49/04* (2006.01)
*D03D 49/20* (2006.01)
(Continued)

(52) U.S. Cl.
CPC ..... *D03D 49/20* (2013.01); *B65H 20/18* (2013.01); *B65H 23/1825* (2013.01);
(Continued)

(58) Field of Classification Search
CPC ..... B29C 55/165; B29C 55/20; B29C 35/10; B29C 70/527; B29C 48/05; B29C 48/07;
(Continued)

(56) References Cited

U.S. PATENT DOCUMENTS 2,990,091 A 6/1961 Goldsworthy et al.
3,556,888 A * 1/1971 Goldsworthy ..... B23Q 7/042 156/73.2
(Continued)

FOREIGN PATENT DOCUMENTS

DE 2 314 889 10/1974
JP 2007-039231 A 2/2007
JP 2015-147630 A 8/2015

OTHER PUBLICATIONS

PCT, English translation of the International Search Report of the International Searching Authority for International Application PCT/EP2016/076490, dated Mar. 6, 2017, 2 pages, European Patent Office, HV Rijswijk, Netherlands.
(Continued)

*Primary Examiner* — Robert H Muromoto, Jr.
(74) *Attorney, Agent, or Firm* — W. F. Fasse

(57) ABSTRACT

A method and an apparatus for producing and drawing-off a woven fabric web (2) with a weaving machine (1) make use of two clamp carriers (7.1, 7.2) with clamps (10.1, 10.2). The clamp carriers are driven back and forth parallel to a drawing-off direction of the fabric web. The clamp carriers are respectively drivable with a pair of drive spindles (14.1, 14.2) arranged so that the web center of the fabric web within the apparatus extends in an area between the two drive spindles of the respective clamp carrier. The fabric web is produced with successive main sections (4.1, 4.2, 4.3, 4.4) and auxiliary sections (3.1, 3.2, 3.3, 3.4, 3.5). The clamps are actuated so that the opening and closing of the
(Continued)

clamps takes place only in the time segments of the production in which an auxiliary section of the fabric web is being produced.

15 Claims, 5 Drawing Sheets

(51) Int. Cl.

| | |
|---|---|
| ***B65H 20/18*** | (2006.01) |
| ***D03D 49/12*** | (2006.01) |
| ***B65H 23/182*** | (2006.01) |
| ***D03D 51/00*** | (2006.01) |
| *D03D 49/00* | (2006.01) |

(52) U.S. Cl.
CPC ..... *D03D 49/12* (2013.01); *D03D 51/005* (2013.01); *B65H 2301/44338* (2013.01); *B65H 2403/52* (2013.01); *B65H 2404/68* (2013.01); *B65H 2405/52* (2013.01); *B65H 2515/31* (2013.01); *B65H 2555/10* (2013.01); *B65H 2701/18* (2013.01); *D03D 2700/265* (2013.01)

(58) Field of Classification Search
CPC ..... B65H 20/18; B65H 20/00; B65H 2301/44336; B65H 2406/342; B65H 2406/351; B65H 51/18; B65H 5/04; B65H 5/10; B23Q 7/042; B21C 1/20; B21C 35/02; D03D 39/226; D03D 49/60
See application file for complete search history.

(56) References Cited

U.S. PATENT DOCUMENTS

| | | | | | |
|---|---|---|---|---|---|
| 3,819,073 | A * | 6/1974 | Asselborn | B21C 1/20 | 414/431 |
| 3,935,724 | A * | 2/1976 | Finsterwalder | B21D 45/06 | 72/345 |
| 4,478,360 | A * | 10/1984 | Patkos | B65H 20/18 | 226/163 |
| 4,712,493 | A * | 12/1987 | Aso | D05B 3/14 | 112/112 |
| 5,341,547 | A * | 8/1994 | Rutz | B29C 55/165 | 26/72 |
| 5,423,354 | A * | 6/1995 | Herrlein | D03D 39/226 | 139/1 E |
| 2009/0284575 | A1* | 11/2009 | Verhoest | B41J 11/001 | 347/104 |
| 2016/0158997 | A1* | 6/2016 | Resch | B29C 55/165 | 425/66 |

OTHER PUBLICATIONS

English Translation of PCT International Preliminary Report on Patentability of the International Searching Authority for International Application PCT/EP2016/076490, dated Mar. 9, 2018, 7 pages, International Bureau of WIPO, Geneva, Switzerland.

* cited by examiner 15
3.1
7.2
4.1
3.2
7.1
4.2
3.3
2
4.3
3.4
5
1
2.1
2.2
2.3
8
4.4
3.5
2.4
3.5

Section A-A

Section B-B

METHOD AND APPARATUS FOR PRODUCING AND DRAWING-OFF A WEB-SHAPED PRODUCT, PARTICULARLY A WOVEN FABRIC WEB

FIELD OF THE INVENTION

The present invention relates to a method and an apparatus, particularly including a weaving method and a weaving machine, for producing and drawing-off a web-shaped product, particularly a woven fabric web.

BACKGROUND INFORMATION

In the prior art, methods and apparatuses are known, with which elongated and web-shaped products are continuously produced and subsequently drawn-off directly from the production machine or from a supply roller, in order to supply them to a further processing or treatment process.

Such a method and such an apparatus is shown, for example by U.S. Pat. No. 2,990,091. This relates to the impregnating of fibers for the production of an elongated fiber reinforced plastic material. The fibers are drawn-off under constant speed from supply rollers and are thereby held under tension. In the tensioned condition, the fibers run through further processing stations. An apparatus with two clamp carriers with clamps for the plastic material to be drawn-off serves for the drawing-off and maintaining of the tension. Guide bolts for the clamp carriers are present in the apparatus frame, on which guide bolts the clamp carriers are guided shiftably in the drawing-off direction. Furthermore a cam disc mechanism is present, by which the clamp carriers are drivable moving back and forth in a travel or shifting range. The clamp carriers are not drivable independently of one another. The travel or shifting displacement is not adjustable and also cannot be very long due to the construction. An adaptation to changed product characteristics or to changed method sequences is thus only possible with difficulty. The guide bolts are tightly clamped into the apparatus frame only at their ends, so that under high tension forces and long travel or shifting displacements it is possible for the guide bolts to bend-through or buckle.

U.S. Pat. No. 3,556,888 describes a similar method as U.S. Pat. No. 2,990,091. In that regard, the drawing-off is served by an apparatus in which several hydraulically driven clamp segments are arranged distributed over the width of the product. The clamp carriers are guided and driven at the bottom side with respect to the apparatus frame. The feed advance in the drawing-off direction is served by a continuously running drive chain, onto which the clamp carriers are coupled-on or uncoupled via a pawl. The force application point of the drive chain and the guide track of the clamp carriers in the apparatus frame have a large spacing distance from the plane in which the tension is developed in the product to be drawn-off. Thereby, with high drawing-off tensions, there exists the danger of deformations and/or over-stressing. A high precision of the alternating motion of the two clamp carriers is hardly achievable.

U.S. Pat. No. 3,819,073 discloses an apparatus for drawing-off pipes or cables from a production machine. The drive of the clamp carriers is achieved via a common drive spindle that is driven by a single motor. The force application point of the drive spindle on the clamp carriers is located below the plane in which the tension is applied to the product to be drawn-off. For the alternating feed advance and return transport of the clamp carriers, these are connected with the drive spindle in a varying manner through a transmission with auxiliary motor. Parallel to the drive spindle, a further spindle is provided, on which several mechanical contact stops are mounted, which serve for operating end switches for the traversing or displacing motions of the clamp carriers.

U.S. Pat. No. 4,478,360 discloses a drawing-off device for band-like material with two clamp carriers that are arranged on both longitudinal sides of the band-like material. The associated clamps alternately grasp the edge or rim of the band-like material respectively from one of the two longitudinal sides. Such an asymmetrical arrangement is not suitable for a precise drawing-off with high tensions.

SUMMARY OF THE INVENTION

It is an object of one or more embodiments of the present invention to produce a method and an apparatus with which a band-like material in the form of a woven fabric web can be produced and drawn-off, which, during its production, requires a high constant tension and high precision of the drawing-off motion with respect to the production machine in the form of a weaving machine.

The above object can be achieved by a method and an apparatus as set forth herein.

In the scope and context of the present invention, a method is proposed in order to produce a web-shaped product in the form of a woven fabric web with a production machine in the form of a weaving machine, wherein the web-shaped product is held under tension or tensile stress during the production. The tension is produced at the outlet of the production machine by an apparatus with which the web-shaped product is also drawn-off from the production machine. In that regard, the drawing-off apparatus operates with two clamp carriers with clamps for the web-shaped product, as well as with drive means by which the clamp carriers are driven moving back and forth parallel to a drawing-off direction of the web-shaped product. The method includes the following features:

Producing the woven fabric web;

Drawing-off the woven fabric web by the clamp carriers, which are drivable moving back-and-forth, as well as opening and closing of the clamps;

Applying a tension or tensile force onto the woven fabric web by actuating the drive means of the clamp carriers with the clamps.

According to the invention, the proposed method is characterized in that the woven fabric web is produced with successive main sections and auxiliary sections, each of the drive spindles is driven with its own drive motor, by means of which the clamp carriers, which carry out the travel or shifting displacements that are adjustable independently from each other, are driven, whereby the clamps are actuated in such a manner so that the opening and closing of the clamps takes place only in the time segments of the production in which an auxiliary section of the woven fabric web is being produced, whereby one of the two clamps is always closed and the woven fabric web is always connected to one of the clamp carriers on an auxiliary section.

In an embodiment of the method, the clamps are furthermore actuated in such a manner so that during the drawing-off, only auxiliary sections of the woven fabric web that have already been produced are grasped by the clamps. Thereby it is to be ensured that the main sections of the woven fabric web are free of damages due to the grasping with the clamps.

For applying the tension to the woven fabric web it is advantageous if the drive means of the clamp carriers are actuated dependent on the prescribed tension. For this purpose, the tension can be measured, for example with strain gages at suitable locations of the clamps or of the clamp carriers.

It is, however, especially advantageous if the drive means are embodied as drive motors with drive spindles, whereby the drive spindles drive the clamp carriers in the drawing-off direction or in the direction of the tension. In this case, the rotational moment or torque of the drive motors can be measured via the electrical actuation of the drive motors and—after corresponding transformation by calculation—can be used for the tension force dependent actuation of the drive motors.

The method according to the invention can be used especially advantageously in the production of certain—usually technical—woven fabrics with a weaving machine.

For such woven fabrics it is usually sufficient if it comprises successive main sections with limited length, whereby certain woven fabric characteristics must be present in these main sections. In the making-up or finishing, or further processing, of these woven fabrics, only these main sections of the woven fabric are utilized. It is therefore possible to weave auxiliary sections between the main sections, which auxiliary sections then become waste during the finishing or making-up.

The method according to the invention is especially advantageous in the production of multi-layered woven fabrics. These fabrics can be very thick—for example in the range of 5 mm to 80 mm—but even greater thicknesses are also possible. If then also fibers are utilized in the weft and/or the warp that are very stiff—i.e. slightly flexible, after the weaving process the finished fabric can no longer be wound up in the classical manner on a roller, but rather it must be drawn-off from the weaving machine essentially in the production direction—usually horizontally.

In these cases, with the proposed method, the main sections of the web-shaped product can then be produced for example as a multi-layered woven fabric with a defined tension and a defined weft spacing or weft density, while auxiliary sections are produced therebetween, which do not need to comprise any particular fabric characteristics, but rather which merely serve to separate the main sections from one another. The defined tension in the area of the main sections can easily amount to values of up to 20 KN in multi-layered technical fabrics. Because such fabrics are often utilized also in the field of fiber-reinforced plastics with high demands or requirements for the uniformity of the mechanical characteristics, a constant tension and especially a constant defined weft spacing or density is important especially during the production of the main sections of the fabric. That means that the drawing-off speed must be very constant during the production of the main sections. Thereby uniform defined spacing distances from one inserted weft thread to the next inserted weft thread (=weft spacing or density) are achieved.

Because, according to the invention, the opening and closing of the clamps during the drawing-off takes place only in the time segments of the production in which the auxiliary sections are being woven, therefore such fluctuations of the tension and/or of the weft density, which could arise unintentionally during the transfer of the fabric from one to the other clamp carrier, can only arise there (at the auxiliary sections). Thus, during the production of the main sections, no such transfer from one to the other clamp carrier takes place.

With correct selection of the spacing distances between the drawing-off apparatus and the weaving machine, and with corresponding adjustment and sequencing of the travel or shifting displacements of the clamp carriers, it can furthermore be achieved that the fabric web is grasped by the clamps only on the auxiliary sections during the drawing-off. That helps to avoid damages of the fabric surface in the main sections. In that regard, for specifying or setting the travel or shifting displacements of the clamp carriers, for the method proposed here and for the apparatus described in the following, the following geometric boundary conditions will pertain.

For the production of a certain length of a complete fabric piece with an auxiliary section and a main section, a travel or shifting displacement for the clamp carriers is required that is as large as the complete length of the fabric piece to be woven. In that regard, the travel or shifting displacement of the clamp carriers is defined as the spacing distance between the two outermost positions of the clamps or of the clamp carriers at the beginning and at the end of the apparatus. In order that a transfer from one to the other clamp can take place, while an auxiliary section of a subsequent fabric piece is being produced, the spacing distance between the outlet of the weaving machine and the beginning of the travel or shifting displacement for the clamp of the first clamp carrier may not be larger than the length of a complete fabric piece. In order to ensure the above described optimum transfer from one to another clamp, thus the length of a complete fabric piece must be within the travel or shifting displacement, while the auxiliary section of a subsequent fabric piece is being produced.

If—beginning from the previously specified boundary condition—also fabric pieces that are smaller than the previously described fabric pieces are to be produced with the same apparatus, then the travel or shifting displacement in total—thus the spacing distance between the two outermost positions of the clamps or the clamp carriers at the beginning and at the end of the apparatus—must be lengthened. There thus arises a travel or shifting displacement of the two clamps or the two clamp carriers that is larger than a complete length of the fabric piece to be woven, namely twice as large as the length of the smallest fabric piece to be woven. Simultaneously the spacing distance between the outlet of the weaving machine and the beginning of the travel or shifting displacement for the clamp of the first clamp carrier must be reduced, and particularly to ½ of the above defined travel or shifting displacement.

In the scope and context of the invention, furthermore an apparatus for drawing-off a woven fabric web from a production machine embodied as weaving machine with two clamp carriers with clamps for the woven fabric web is proposed. The apparatus comprises an apparatus frame on which guide means for the clamp carriers are mounted. Furthermore drive means embodied as drive motors with drive spindles are present, by which the clamp carriers are drivable moving back and forth parallel to a drawing-off direction of the woven fabric web in a travel or shifting range. According to the invention, the apparatus is characterized in that each one of the two clamp carriers, which carry out the travel or shifting displacements that are adjustable independently from each other, is drivable with a pair of drive spindles that are each respectively driven with one drive motor, wherein the drive spindles are arranged in such a manner so that the web center of the woven fabric web extends within the apparatus in an area or range between the two drive spindles of the respective clamp carrier and the clamps of the clamp carriers are openable and closeable by means of a clamp control in such a manner, so that one of the two clamps is always closed. With the pair of drive spindles constructed in such a manner a uniform distribution of the tension of the woven fabric web onto the clamp carriers and onto the drive spindles is achieved.

Furthermore an apparatus is favorable, in which the drive spindles and the woven fabric web extend in the same plane. Thereby the force introduction onto the spindles occurs on the shortest possible path without unnecessary deflections and under substantial avoidance of deformations of the spindles.

Of course, an arrangement is also possible in which the drive spindles are arranged in a plane that extends parallel to the plane in which the woven fabric web extends. The previously mentioned favorable force introduction onto the spindles is, however, only then still ensured, if the spacing distance of the one plane to the other plane is not too large—for example smaller than the 3-fold diameter of the drive spindles.

A uniform distribution of the tensions or the drive forces of the spindles within the clamp carriers can additionally be achieved in that the drive spindles are arranged symmetrically to the middle of the clamp carriers in the direction of the width of the woven fabric web.

A further favorable embodiment of the apparatus arises if the drive spindles extend over the entire length of the travel or shifting range, whereby each pair of drive spindles, by which one of the two clamp carriers is drivable, is supported in the respective other clamp carrier.

Through this arrangement, almost the entire travel or shifting displacement that is available in the apparatus is traversable by both clamp carriers. And even with long drive spindles—that is to say long travel or shifting displacements—a through-going bending or oscillation of the drive spindles between the two end positions of the travel or shifting displacement is reduced.

The setting or adjusting and the actuation of the shifting motion of the drawing-off apparatus should be adaptable to the characteristics of the woven fabric web with auxiliary sections and main sections having different lengths. Moreover it can occur that the woven fabric web within the apparatus is not arranged symmetrically over the width, but instead extends or runs in a one-sided manner. In that regard, the web widths can for example amount to 50 cm to 150 cm. For these reasons it is advantageous if each one of the drive spindles is drivable with its own drive motor. Thereby the travel or shifting displacements of each clamp carrier can be adjusted independently of the other clamp carrier. Moreover an asymmetrical distribution of the tensions on each of the two clamp carriers can be supported or absorbed via an asymmetrical actuation of the two associated drive motors.

For reasons of accessibility it is sensible to arrange all drive motors at the end of the travel or shifting range in the drawing-off direction of the web-shaped product.

In order to achieve the fewest possible and the most symmetrical possible strains and deformations within the apparatus, in further embodiment of the apparatus it is provided to carry out the guide means as guide tracks that are arranged symmetrically to the middle of the clamp carriers in the direction of the width of the woven fabric web.

In that regard it is especially advantageous if the guide tracks are supported or braced in the apparatus frame over their entire length.

In a further embodiment of the apparatus, at least one roller for drawing-off the web-shaped product from one of the two clamp carriers is arranged on this clamp carrier, preferably two rollers are provided. The roller gap is adjustable. At least one of the two rollers is motor-drivable. Thereby the automatic further transport of the web-shaped product is ensured at the outlet of the apparatus.

The apparatus according to the invention can be utilized in an especially advantageous manner in connection with a weaving machine. Thereby it becomes possible to carry out the above described method, for example in the production of multi-layered woven fabrics.

BRIEF DESCRIPTION OF THE DRAWINGS

In order that the invention may be clearly understood, it will now be described in connection with example embodiments thereof, with reference to the accompanying drawings, wherein.

DETAILED DESCRIPTION OF EXAMPLE EMBODIMENTS OF THE INVENTION

Figures 1A, 1B, 1C:
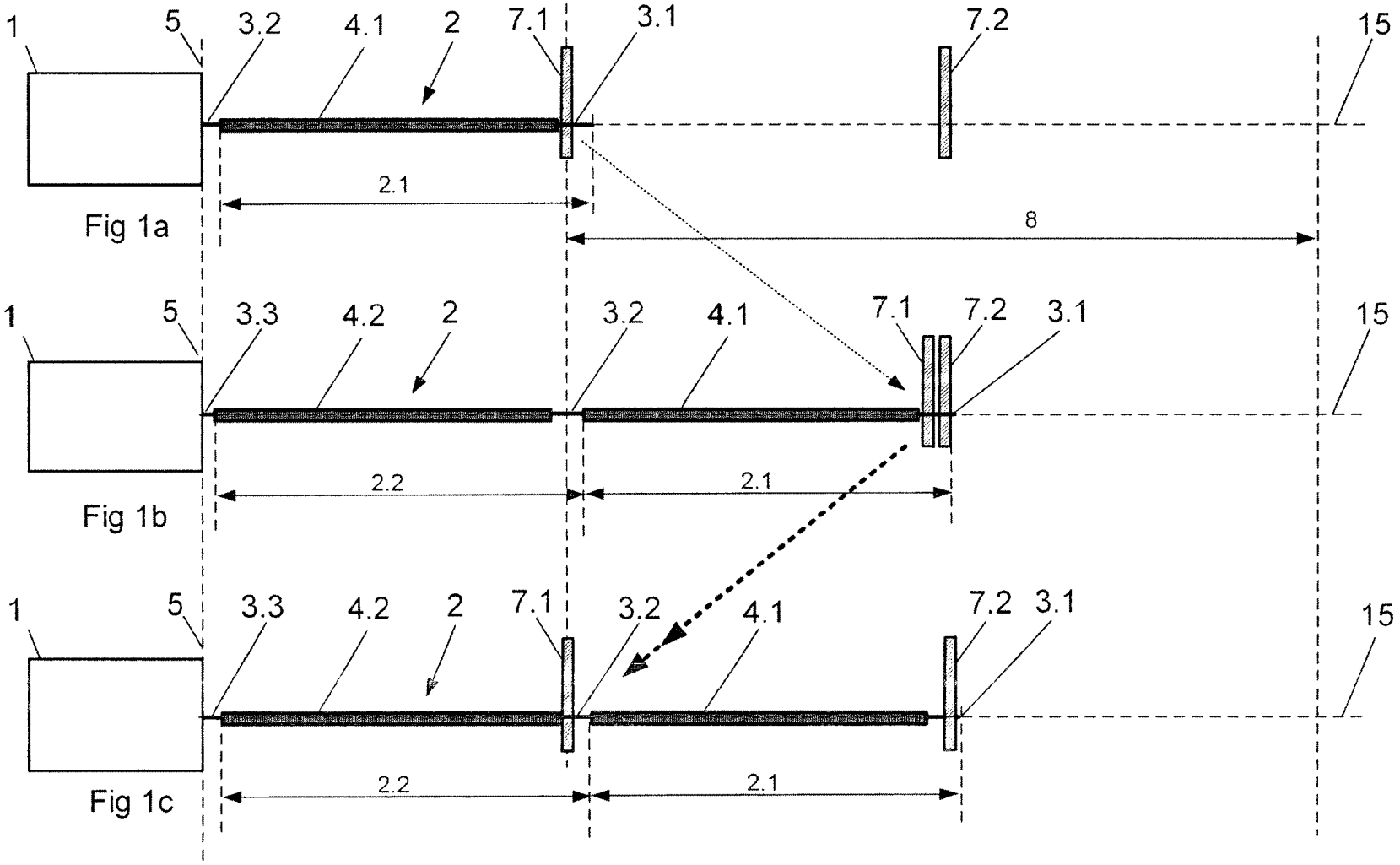
FIG. 1 *a-f* is a schematic illustration of an embodiment of the method according to the invention.

The FIGS. 1*a* to 1*f* show successive method steps of an embodiment of the method according to the invention.

The production machine—presently a weaving machine 1—produces successive pieces 2.1, 2.2 of a multi-layered woven fabric. Each one of the woven pieces 2.1, 2.2 consists of an auxiliary section 3 and a main section 4. The main section 4 is the basis for the end product, which is to be produced. The auxiliary sections 3 are generally significantly shorter than the main sections 4; they serve merely for separating and handling of the main sections 4. Generally different weave patterns are utilized for the two sections 3, 4 of a woven fabric piece 2.1 or 2.2 etc. that is to be produced. The switching-over between the two weaving styles or weave patterns for the two sections 3, 4 of a fabric piece 2.1, 2.2 etc. is achieved automatically with a running weaving machine 1. For this, weft insertion, loom formation, warp and product control are activated from an electronic control console in a way and manner that is known to the skilled artisan. The different weave patterns are stored in the form of electronic pattern data in the weaving machine control. The produced fabric pieces 2.1, 2.2 are most suitably led away from the weaving machine 1 in the horizontal direction. At the start of a new production, the first fabric section 2.1 is generally grasped by the operator and fed to the following drawing-off apparatus 6, which automatically carries out the further method steps from then on.

FIG. 1*a* shows that the weaving machine 1 has already produced a fabric piece 2.1 with a first auxiliary section 3.1 and a first main section 4.1, and that at the moment a second auxiliary section 3.2 is being produced, which is exiting the weaving machine 1 at the outlet 5. The outlet 5 is the so-called interlacing point or fabric edge of the woven fabric in the weaving machine 1. This is the point or the line at which an inserted weft thread is beat-up against the already produced fabric web 2 by means of a weaving reed and is bound-in by warp threads that form a loom shed. These details of the weaving machine 1 are known to the skilled artisan and therefore do not need to be further illustrated here.

The auxiliary section 3.1 that has already been produced is grasped by a clamp 10.1 in an apparatus 6 for drawing-off the fabric web 2, and is thereby connected with a first clamp carrier 7.1. The drawing-off apparatus 6 comprises two clamp carriers 7.1, 7.2 with clamps 10.1, 10.2 for the fabric web 2. Furthermore the apparatus 6 has drive means by which the clamp carriers 7.1, 7.2 can be driven moving back and forth parallel to a drawing-off direction of the fabric web 2. Several details of the drawing-off apparatus 6 are not illustrated in the FIGS. 1*a*-1*f* and are explained further below.

After the grasping of the auxiliary section 3.1 by the clamp 10.1 of the first clamp carrier 7.1, a tension in the drawing-off direction of the fabric web 2 is developed in the fabric piece 2.1 by the drive means of this clamp carrier 7.1. This tension is transmitted further on the weaving machine side via the warp threads up to the warp thread supply—for example a warp beam or a bobbin creel.

The drawing-off of the warp threads from this warp thread supply is controlled via suitable drive or braking means. Generally a measuring apparatus is located in the weaving machine 1, with which measuring apparatus the tension in the warp threads—that is the warp tension or the fabric tension—can be measured. The measuring apparatus for the measuring can of course also be mounted in the area between the clamp carriers 7.1, 7.2 of the drawing-off apparatus 6 and the weaving machine 1. The measured tension is conveyed further to the control devices for the drive or braking apparatuses in the weaving machine 1 and if applicable also to the control devices for the drive means of the clamp carriers 7.

FIG. 1*b* shows that in the further progression of the embodiment of the method illustrated here, already a second main section 4.2 has been produced. During that, the first clamp carrier 7.1 was shifted or displaced in the drawing-off direction. In that regard, the tension in the fabric web 2 was maintained at a constant level by corresponding actuation of the drive or braking means. In FIG. 1*b* it is further shown that in the time segment in which a further auxiliary section 3.3 is being woven, the clamp 10.2 of the second clamp carrier 7.2 grasps the first auxiliary section 3.1 of the fabric piece 2.1 and connects it with the second clamp carrier 7.2.

Thereupon, via the drive means of the second clamp carrier 7.2, a tension is developed in the fabric piece 2.1 and thereafter the clamp 10.1 of the first clamp carrier 7.1 is opened.

While the auxiliary section 3.3 is still being produced by the weaving machine 1, the first clamp carrier 7.1 is again shifted or displaced back to its starting position at the inlet of the drawing-off apparatus 6.

In the reverse or backwards motion, the clamp carriers 7 have a significantly higher shifting speed than in the forwards operation. Possible shifting speeds are for example 200 mm per minute in the forwards operation (that is to say the production speed of the weaving machine) and 3000 mm per minute in the reverse or backwards operation. Depending on the type of the woven fabric, of course also other shifting speeds can be necessary. The drive means of the clamp carriers 7 are to be correspondingly designed or engineered for that.

The different speeds of the clamp carriers 7 in the different method steps are illustrated by diagonally extending arrows or double arrows in the FIGS. 1*a*-1*f*.

The state or condition after the previously described return shifting of the first clamp carrier 7.1 into the starting position is illustrated in FIG. 1*c*. In this position, the clamp 10.1 of the first clamp carrier 7.1 is again closed and thereby grasps the fabric web 2 at the auxiliary section 3.2. Thereby the tension in the fabric web 2 is again taken up by the first clamp carrier 7.1. The second clamp carrier 7.2 is still closed on the auxiliary section 3.1. The tension in the fabric web 2 between the second and the first clamp carrier 7.1, 7.2 can now be reduced because it plays no role for the production process in the weaving machine 1. It must simply be prevented that the fabric web 2 sags down between the clamp carriers 7.1, 7.2.

Figures 1D, 1E, 1F:
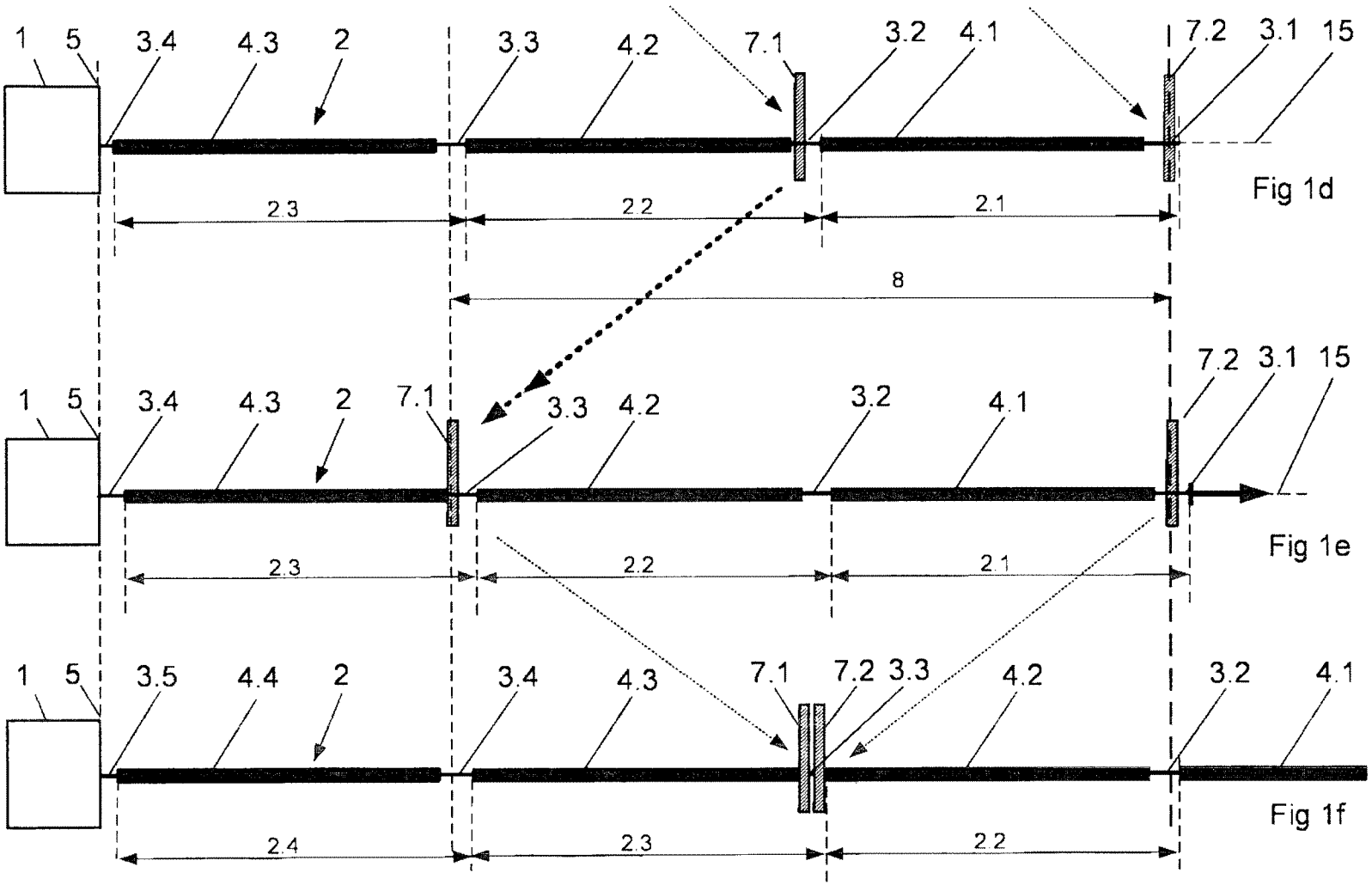

In FIG. 1*d*, the further progress of the method is to be seen. In the meantime, a further main section 4.3 has been produced by the weaving machine 1. In that regard, the two clamp carriers 7.1, 7.2 with the already-produced fabric pieces 2.1, 2.2 were further shifted or displaced at the production speed in the drawing-off direction. The clamp 10.2 of the second clamp carrier 7.2 at first still remains closed and it now again takes over the entire tension in the fabric web 2. Next the clamp 10.1 of the first clamp carrier 7.1 is opened and the first clamp carrier 7.1 is shifted or displaced again into its starting position at an elevated shifting speed. During this process the weaving machine 1 produces the auxiliary section 3.4.

FIG. 1*e* shows that at the end of the apparatus 6 facing away from the weaving machine 1, the woven fabric 2 is now taken over by an operator or by a further transport apparatus—this is illustrated symbolically by the arrow in the drawing-off direction. In the meantime, the clamp 10.1 of the first clamp carrier 7.1 has been closed on the auxiliary section 3.3, and the first clamp carrier 7.1 has again taken over the entire tension between weaving machine 1 and drawing-off apparatus 6. Now the clamp 10.2 of the second clamp carrier 7.2 can be opened.

In a further method step—see FIG. 1*f*—now the second clamp carrier 7.2 is shifted back into its starting position. In this time, the weaving machine 1 produces a further main section 4.4. In parallel with this, the first clamp carrier 7.1 with the clamped auxiliary section 3.3 is shifted in the drawing-off direction. Just then the weaving machine 1 begins to produce the auxiliary section 3.5. Simultaneously the clamp 10.2 of the second clamp carrier 7.2 closes at the auxiliary section 3.3 and takes over the total or entire tension in the fabric web 2. As a next step, the clamp 10.1 of the first clamp carrier 7.1 opens, and it is shifted at an elevated shifting speed back into its starting position, where it then grasps the auxiliary section 3.4. Therewith a complete method cycle is completed. The two clamp carriers 7.1, 7.2 again have the positions as illustrated in FIG. 1*a* or actually Figure is for ongoing production. The process continues from there on in a corresponding manner.

Through this method sequence or progression it is ensured that during the production of the main sections 4 of the fabric pieces 2.1, 2.2 etc., no transfer or taking-over of the drawn-off fabric web 2 from one to the other clamp carrier 7.1, 7.2 takes place. Thereby possibly arising inaccuracies in the progression due to slipping or stretched fabric, which could arise during the opening and closing of the clamps 10, only become effective during the production of the auxiliary sections 3. In the auxiliary sections 3, however, a possible deviating or fluctuating fabric quality plays no role or is irrelevant, because these sections are not used anyway in the end product which is produced from only the main sections 4. A further advantage of the embodiment of the method according to the invention as described here exists in that the clamps 10.1, 10.2 of the clamp carriers 7.1, 7.2 never grasp the fabric web 2 on the main sections 4 of the fabric pieces 2.1, 2.2, but rather always only on the auxiliary sections 3. A damaging of the main sections 4 by the clamps 10 is thereby completely excluded.

That is especially suitable or sensible, for example, in the production of multi-layered woven fabrics for application in fiber composite structural components. The fibers of these fabrics are often very sensitive or delicate on their surface. Damages of the fibers or of the individual filaments of a fiber cause problems in the following processing or treatment processes.

Figure 2:
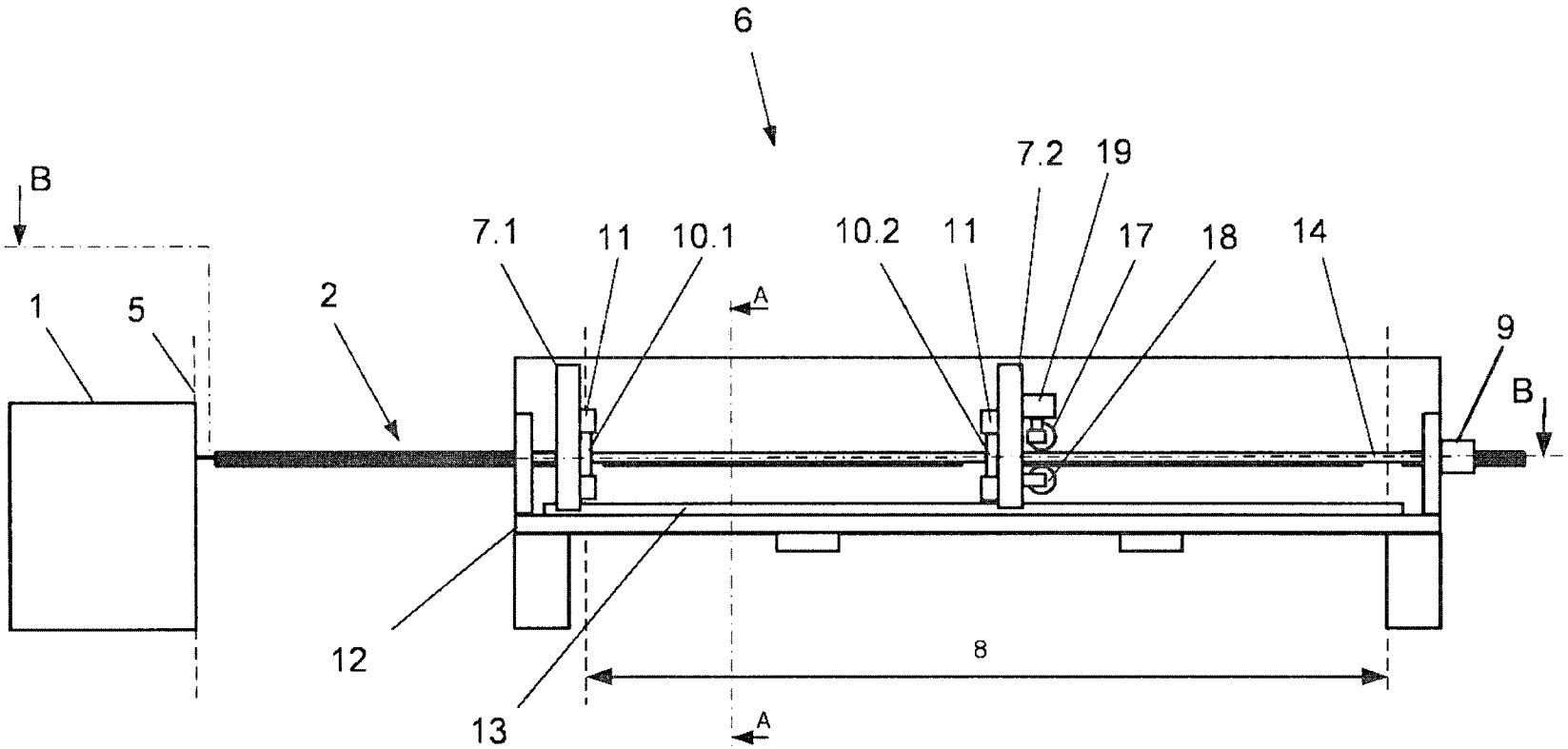
FIG. 2 is a schematic illustration of an embodiment of the apparatus according to the invention in a side view.
Figure 3:
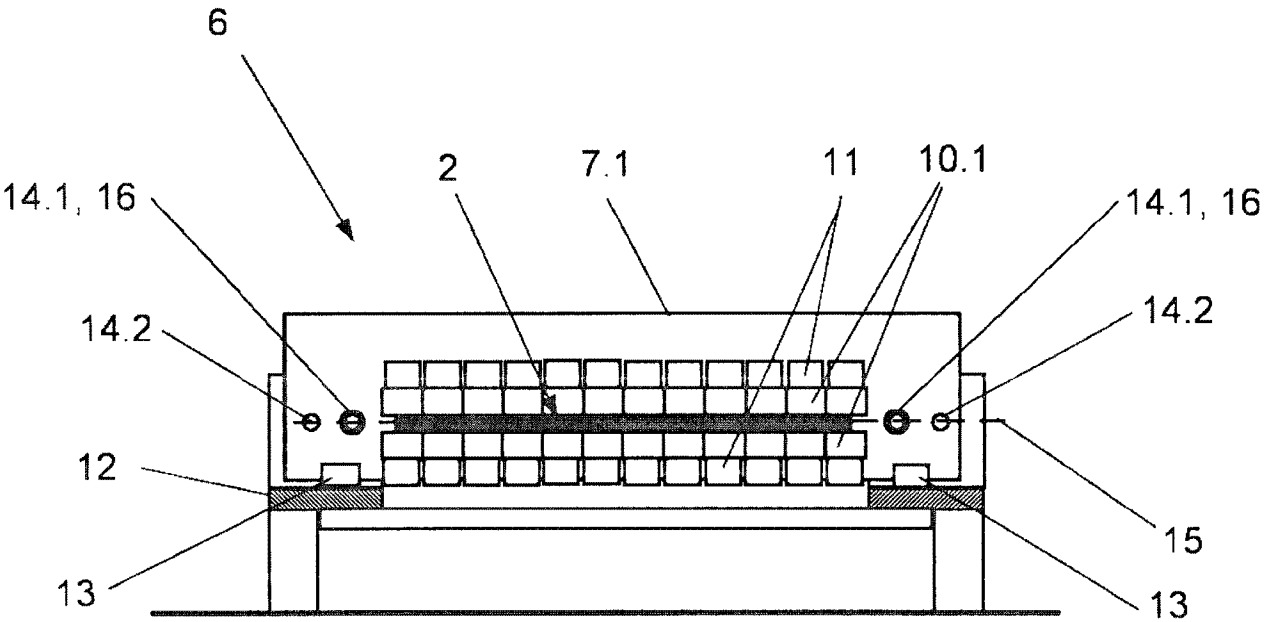
FIG. 3 is a sectional view showing section A-A of the apparatus according to FIG. 2.
Figure 4:
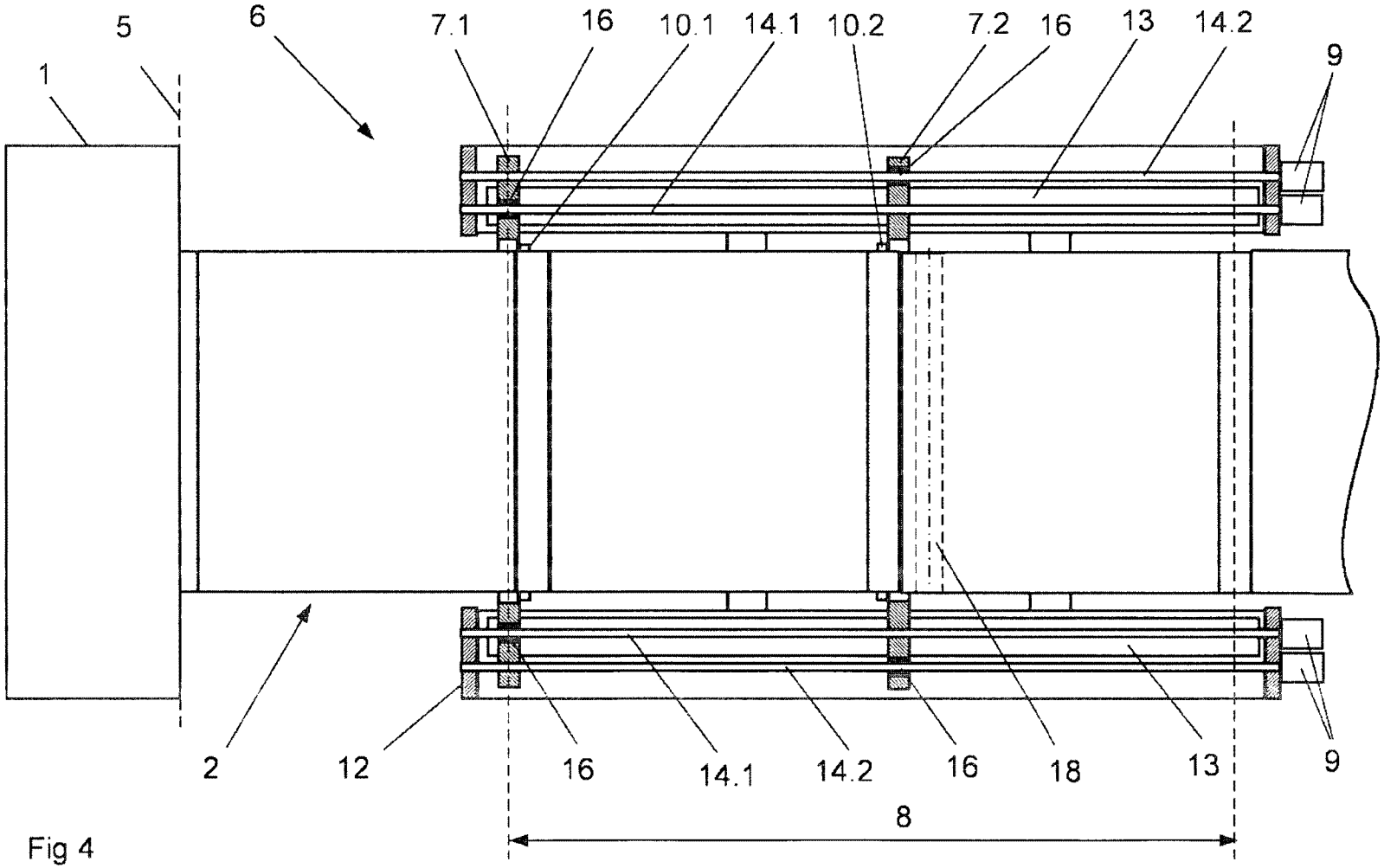
FIG. 4 is a sectional schematic illustration showing section B-B of the apparatus according to FIG. 2 in a view from the top.

The FIGS. 2-4 show an embodiment of an apparatus 6 according to the invention for drawing-off a woven fabric web. Illustrated is the construction together with a weaving machine 1. The entire arrangement is suitable and able to carry out the above described method according to the invention.

The apparatus 6 includes two clamp carriers 7.1 and 7.2 with clamps 10.1, 10.2 for the fabric web 2. An apparatus frame 12 is present, via which the apparatus 6 is supported on the floor. Guide tracks 13 for the clamp carriers 7 are arranged on the apparatus frame 12, which guide tracks, in the present example, are supported or braced on the apparatus frame 12 over the total or entire length of the possible travel or shifting displacement 8 of the clamp carriers 7. These guide tracks 13 can be embodied as profiled sliding guides or low-friction guides or as roller body guides—so-called ball guides. Thereby, a precise guidance of the clamp carriers 7 without larger deformations of the guide tracks 13 is achieved. In the present example embodiment, the guide tracks 13 are arranged symmetrically to the middle of the clamp carriers 7 in the direction of the width of the fabric web 2 (FIG. 3), in order to uniformly distribute the forces with which the clamp carriers 7 are supported in the apparatus 6.

The apparatus 6 further includes two pairs of drive spindles 14.1, 14.2, by which the clamp carriers 7.1, 7.2 are driven parallel to the drawing-off direction of the fabric web 2. One pair of these drive spindles 14.1, 14.2 is allocated to each clamp carrier 7.1, 7.2. The drive spindles 14 are arranged in such a manner so that the web center of the fabric web 2 within the apparatus 6 extends in an area between the two drive spindles 14 of the respective clamp carrier 7. Thereby, a symmetrical force introduction is achieved from the clamp carriers 7 into the drive spindles 14, when the clamp carriers 7 are under the tension of the fabric web 2.

In the present example, the drive spindles 14 are arranged in the same plane 15 in which the fabric web 2 also extends in the apparatus 6. This is more advantageous than an arrangement in different parallel planes with a large vertical spacing distance between fabric web 2 and drive spindles 14, because thereby undesired deformations of the clamp carriers 7 and of the drive spindles 14 can arise under high tensions.

The drive spindles 14 are presently arranged symmetrically to the middle of the clamp carriers 7 in the direction of the width of the fabric web 2. This also serves for the symmetrical introduction of forces into both drive spindles 14.1 or 14.2 of the respective clamp carrier 7.1 or 7.2. This pertains at least when the fabric web 2 is similarly drawn or pulled through the apparatus 6 symmetrically to the middle of the clamp carriers 7.1, 7.2 with respect to the width of the fabric web.

So that fabric webs 2 with different widths can be drawn-off, the clamps 10.1, 10.2 of the clamp carrier 7.1, 7.2 are respectively constructed of several pairs of clamp segments. This can best be seen in FIG. 3. These clamp segments are arranged next to one another distributed over the width of the clamp carriers 7. Each one of these clamp segments can be driven with a clamp actuator 11 independently of the other clamp segments. That is to say, the pairs of clamp segments allocated to one another respectively form a clamp 10 that can be opened or closed independently of the other clamps. In the present example, pneumatic cylinders are used as clamp actuators 11. Of course, other types of actuators 11—for example hydraulic or electromagnetic actuators 11—can also be used for operating the clamps 10.

FIG. 4 shows the apparatus 6 for drawing-off the fabric web 2 in a view from the top. One recognizes that the drive spindles 14 extend over the entire length of the travel or shifting range 8. Each pair of drive spindles 14.1, 14.2, by which one of the two clamp carriers 7.1, 7.2 is drivable, is supported in the respective other clamp carrier 7.2, 7.1. Spindle nuts 16 are provided in the clamp carrier 7 at that location where the drive forces of the drive spindles 14 are applied onto the respective clamp carrier 7. Upon rotation of the spindle, these spindle nuts 16 transmit tension or compression forces in the drawing-off direction onto the respective clamp carrier 7.

Bearing bushings, which are not further illustrated, are provided at the location where the two drive spindles 14.2 or 14.1 of the respective one clamp carrier 7.2 or 7.1 are guided through the respective other clamp carrier 7.1, 7.2, wherein these bearing bushings ensure a support or bracing of the drive spindles of the one clamp carrier 7.2 or 7.1, in the respective other clamp carrier 7.1 or 7.2. Thereby, excessive bending of longer drive spindles 14 is reduced.

Each one of the drive spindles 14 is drivable with its own drive motor 9. The rotational moment or torque of the drive motors 9 can be measured in a known manner, e.g. via the current consumption of the electronic motor controller, and can be used for actuating the drive motors 9. The position determination of the two clamp carriers 7 within the apparatus 6 is achieved, for example, via an inductive displacement or travel distance measuring system—possibly in the area of the guide tracks 13—or via incremental signal transmitters within the drive motors 9. Thereby the current position of the respective clamp carrier 7 is determined from the number of the pulses or rotations of the drive motors 9 via the spindle pitch.

The drive motors 9 for the drive spindles 14 are presently mounted at the end of the apparatus 6 that faces away from the weaving machine 1. On this side, axial bearings of the drive spindles are also provided in the apparatus frame. The tensions in the fabric web 2 therefore produce tension forces in the drive spindles 14. Compressive forces can arise in the drive spindles 14 only during the return shifting of the clamp carriers 7 contrary to the drawing-off direction. These are, however, small so that no danger of impermissible deformations or even kinking or buckling exists.

The present embodiment of the apparatus 6, on the second clamp carrier 7.2, comprises two drawing-off rollers 17, 18 that form an adjustable roller gap therebetween. For adjusting the roller gap, the upper drawing-off roller 17 can be brought into different positions perpendicularly to the fabric web 2. A suitable actuator 19—for example a geared motor with spindle—serves for this positioning relative to the fabric web 2. For the drive, the lower drawing-off roller 18 includes, for example in the interior, an electric drum motor—however also other drive types with motors outside of the drawing-off roller 18 are also possible. It is also conceivable to drive the upper drawing-off roller 17 or both rollers 17, 18. With this roller pair 17, 18, the drawn-off fabric web 2 can be further transported on the far side of the second clamp carrier 7.2. Moreover, if needed, the already drawn-off fabric web 2 can be supported with this roller pair 17, 18 while the second clamp carrier 7.2 is on the return travel path from its end position into the starting position (see FIGS. 1*e* and 1*f*).

With the described apparatus, other method sequences can also be realized. For example, it would also be possible to control the sequence so that during most of the method steps the complete tension of the fabric web is taken up not by the first clamp carrier but rather by the second clamp carrier, whereby the first clamp carrier in these phases only develops an auxiliary tension which serves to prevent an excessive sagging of the fabric web. In order to ensure the safety of the operators, the open accessible travel or shifting ranges of the clamp carriers 7, the roller gap between the drawing-off rollers, and the running drive spindles 14 are protected by safety light barriers, which are not illustrated. In that regard, safety light barriers are utilized that still reliably indicate an interruption of the light beam or light curtain even with a changed spacing distance between the emitter and the receiver.

REFERENCE NUMBERS

| | |
|---|---|
| 1 | production machine, weaving machine |
| 2 | web-shaped product, fabric web |
| 2.1, 2.2 | fabric pieces |
| 3.1, 3.2, 3.3, 3.4, 3.5 | auxiliary sections of the fabric piece |
| 4.1, 4.2, 4.3, 4.4 | main sections of the fabric piece |
| 5 | outlet of the production machine |
| 6 | apparatus for drawing-off |
| 7.1, 7.2 | first, second clamp carrier |
| 8 | travel or shifting displacement of the clamp carriers |
| 9 | drive motors |
| 10.1, 10.2 | clamps |
| 11 | actuator for operating the clamps |
| 12 | apparatus frame |
| 13 | guide track for clamp carrier |
| 14.1, 14.2 | pairs of drive spindles |
| 15 | fabric plane |
| 16 | spindle nuts |
| 17 | drawing-off roller top |
| 18 | drawing-off roller bottom |
| 19 | actuator for adjusting roller gap |

The invention claimed is:

1. A method of producing a woven fabric web with a weaving machine and drawing-off the woven fabric web with a drawing-off apparatus, wherein the drawing-off apparatus includes two independently movable clamp carriers that respectively carry two fabric clamps, plural drive spindles, and plural drive motors that are each individually operatively connected to a respective individual one of the drive spindles so as to drive the respective drive spindle, wherein the clamp carriers are respectively operatively connected to ones of the drive spindles to be driven by the drive spindles, and wherein the method comprises the steps:

a) with the weaving machine, producing a woven fabric web to include main web sections and auxiliary web sections successively alternating with one another; and b) with the drawing-off apparatus, applying a tension onto the woven fabric web and drawing-off the woven fabric web in a drawing-off direction, by actuating the drive motors to drive the drive spindles respectively connected thereto whereby the drive spindles drive the clamp carriers independently of one another to move independently back-and-forth parallel to the drawing-off direction, and by closing and opening the fabric clamps only during the producing of the auxiliary web sections to grasp and release the auxiliary web sections with the fabric clamps, such that at all times at least either one of the two fabric clamps is closed and at least one of the auxiliary web sections of the woven fabric web is connected with at least either one of the clamp carriers via the at least one closed fabric clamp.

2. The method according to claim 1, wherein the drive motors are actuated and the fabric clamps are closed and opened in synchronism with the producing of the woven fabric so that only the auxiliary web sections of the woven fabric web that have already been produced are grasped by the at least one closed fabric clamp.

3. The method according to claim 1, wherein during the applying of the tension onto the woven fabric web, the drive motors are actuated dependent on the tension.

4. The method according to claim 3, further comprising measuring an output torque produced by the drive motors, and wherein the drive motors are actuated dependent on the measured output torque as an indication of the tension.

5. The method according to claim 1, wherein the producing of the woven fabric web comprises producing the main web sections respectively as a multi-layered woven fabric.

6. An apparatus for drawing-off a woven fabric from a weaving machine, wherein the apparatus comprises:

an apparatus frame;

a guide supported on the apparatus frame;

a first clamp carrier that carries a first fabric clamp, and a second clamp carrier that carries a second fabric clamp, wherein the first and second clamp carriers are arranged to be movable along the guide back-and-forth parallel to a drawing-off direction of the woven fabric web;

a first pair of drive spindles operatively connected to the first clamp carrier to be adapted to move the first clamp carrier independently of the second clamp carrier along the guide in a first motion range, and a second pair of drive spindles operatively connected to the second clamp carrier to be adapted to move the second clamp carrier independently of the first clamp carrier along the guide in a second motion range, wherein the first and second pairs of drive spindles are respectively arranged with a drawing-off centerline in an area between the drive spindles of the first pair and between the drive spindles of the second pair, wherein the apparatus is configured and adapted to draw-off the woven fabric web with a web center of the woven fabric web extending along the drawing-off centerline;

four drive motors that are respectively individually operatively connected to the individual drive spindles of the first and second pairs to be adapted to respectively drive the drive spindles; and a clamp controller configured to control an opening and a closing of the first fabric clamp and of the second fabric clamp so that at least either one of the fabric clamps is closed at all times during the drawing-off of the woven fabric web.

7. The apparatus according to claim 6, wherein the drive spindles all lie in a spindle plane that extends parallel to a fabric plane, the apparatus is configured and adapted to draw-off the woven fabric web extending along the fabric plane, and a spacing distance between the spindle plane and the fabric plane is smaller than three times a diameter of the drive spindles.

8. The apparatus according to claim 6, wherein the drive spindles of the first pair are arranged symmetrically relative to a middle of the clamp carriers in a direction transverse to the drawing-off direction, and the drive spindles of the second pair are arranged symmetrically relative to the middle of the clamp carriers in the direction transverse to the drawing-off direction.

9. The apparatus according to claim 6, wherein each one of the drive spindles extends along an entire length of the first motion range and the second motion range, the drive spindles of the first pair are slidably and rotatably supported by the second clamp carrier, and the drive spindles of the second pair are slidably and rotatably supported by the first clamp carrier.

10. The apparatus according to claim 6, wherein the guide comprises plural guide tracks arranged symmetrically relative to a middle of the clamp carriers in a direction transverse to the drawing-off direction.

11. The apparatus according to claim 10, wherein the guide tracks are supported over an entire length thereof on the apparatus frame.

12. The apparatus according to claim 6, further comprising at least one drivable roller that is mounted on a selected one of the clamp carriers and that is configured and arranged to draw-off the woven fabric web from the fabric clamp carried by the selected clamp carrier.

13. A combination comprising the apparatus according to claim 6 and a weaving machine configured and adapted to produce the woven fabric web.

14. A method comprising the steps:

a) with a weaving machine, producing a woven fabric web to include main web sections and auxiliary web sections successively alternating with one another, wherein the woven fabric web being produced exits from an outlet of the weaving machine;

b) downstream from the outlet of the weaving machine, grasping a first one of the auxiliary web sections with a first fabric clamp at a first position, and while the first auxiliary web section is grasped by the first fabric clamp moving the first fabric clamp in a drawing-off direction away from the outlet of the weaving machine from the first position to a second position to apply a controlled tension onto the woven fabric web between the first fabric clamp and the outlet of the weaving machine and to draw-off the woven fabric web in the drawing-off direction away from the outlet of the weaving machine;

c) while the first auxiliary web section is still grasped by the first fabric clamp after the step b), additionally grasping the first auxiliary web section with a second fabric clamp at a third position on a side of the first fabric clamp away from the outlet of the weaving machine in the drawing-off direction;

d) while the first auxiliary web section is still grasped by the second fabric clamp after the step c), releasing the first fabric clamp from the first auxiliary web section, moving the first fabric clamp opposite the drawing-off direction back to the first position, and at the first position grasping a second one of the auxiliary web sections with the first fabric clamp;

e) while the second auxiliary web section is still grasped by the first fabric clamp after the step d), moving the first fabric clamp in the drawing-off direction from the first position to the second position to apply the controlled tension onto the woven fabric web between the first fabric clamp and the outlet of the weaving machine and to draw-off the woven fabric web in the drawing-off direction away from the outlet of the weaving machine, while also still grasping the first auxiliary web section with the second fabric clamp and moving the second fabric clamp in the drawing-off direction to a fourth position;

f) while the first auxiliary web section is still grasped by the second fabric clamp after the step e), releasing the first fabric clamp from the second auxiliary web section, moving the first fabric clamp opposite the drawing-off direction back to the first position, and at the first position grasping a third one of the auxiliary web sections with the first fabric clamp;

g) while the third auxiliary web section is still grasped by the first fabric clamp after the step f), moving the first fabric clamp in the drawing-off direction from the first position to the second position to exert the controlled tension onto the woven fabric web between the first fabric clamp and the outlet of the weaving machine and to draw-off the woven fabric web in the drawing-off direction away from the outlet of the weaving machine; and h) while the third auxiliary web section is still grasped by the first fabric clamp after the step g), releasing the second fabric clamp from the first auxiliary web section, moving the second fabric clamp opposite the drawing-off direction back to the third position, and additionally grasping the third auxiliary web section with the second fabric clamp at the third position;

wherein:

the grasping and the releasing of the respective auxiliary web sections by the fabric clamps are initiated only while a subsequent one of the auxiliary web sections is being produced and not while any one of the main web sections is being produced, at least either one of the fabric clamps is grasping at least one of the auxiliary web sections at all times during the steps b) to h), and the controlled tension is applied and maintained by the first fabric clamp moving in the drawing-off direction while each one of the main web sections is being produced.

15. The method according to claim 14, further comprising, after the step h), successively repeating the steps d) to h) respectively for a second-subsequent one of the auxiliary web sections that second-next follows after the respective auxiliary web section recited in each respective one of the steps d) to h).

* * * * *